US012773009B2

(12) United States Patent
Harper

(10) Patent No.: US 12,773,009 B2
(45) Date of Patent: Oct. 27, 2026

(54) CIGARETTE HOLDING AND EXTINGUISHING KIT

(71) Applicant: Raymond Harper, Fairfield, CA (US)

(72) Inventor: Raymond Harper, Fairfield, CA (US)

( * ) Notice: Subject to any disclaimer, the term of this patent is extended or adjusted under 35 U.S.C. 154(b) by 467 days.

(21) Appl. No.: 18/383,994

(22) Filed: Oct. 26, 2023

(65) Prior Publication Data

US 2025/0134163 A1 May 1, 2025

(51) Int. Cl.

| | |
|---|---|
| ***A24F 13/12*** | (2006.01) |
| ***A24F 13/18*** | (2006.01) |
| ***A24F 13/22*** | (2006.01) |
| ***A24F 19/00*** | (2006.01) |
| ***A24F 21/00*** | (2006.01) |

(52) U.S. Cl.
CPC ..... *A24F 13/12* (2013.01); *A24F 13/18* (2013.01); *A24F 13/22* (2013.01); *A24F 19/0092* (2013.01); *A24F 21/00* (2013.01)

(58) Field of Classification Search
CPC ..... A24F 13/12; A24F 13/18; A24F 13/22; A24F 19/00092; A24F 21/00
See application file for complete search history.

(56) References Cited

U.S. PATENT DOCUMENTS

| | | | | |
|---|---|---|---|---|
| 1,565,728 | A * | 12/1925 | Gaunt | A24F 19/00 131/232 |
| 1,643,703 | A | 9/1927 | Davenport | |
| 1,976,653 | A * | 10/1934 | Brueck | A24F 13/22 224/217 |
| 2,207,197 | A * | 7/1940 | Havey | A24F 13/22 292/19 |
| 2,309,011 | A | 1/1943 | Porter | |
| 4,262,682 | A | 4/1981 | Banyash | |
| 4,497,329 | A * | 2/1985 | O'Dell | A24F 13/18 131/237 |
| 5,423,335 | A * | 6/1995 | Evans | A24F 19/10 131/232 |
| 5,862,809 | A | 1/1999 | Nicotra | |
| 2004/0084055 | A1 | 5/2004 | Rebensdorf | |
| 2022/0361559 | A1* | 11/2022 | Rand | A24F 19/0035 |

FOREIGN PATENT DOCUMENTS

| | | |
|---|---|---|
| WO | WO2005025343 | 3/2005 |

* cited by examiner

*Primary Examiner* — Michael H. Wilson
*Assistant Examiner* — Daniel Edward Vakili

(57) ABSTRACT

A cigarette holding and extinguishing kit for aiding a user to grasp a cigarette includes a cigarette holder with a handle and a pair of prongs. The handle is elongated between a first end and a second end of the handle. The pair of prongs is coupled to the second end of the handle and extends parallel to a central longitudinal axis of the handle away from the second end. The prongs are laterally spaced from each other with respect to the handle. Each prong of the pair of prongs is resiliently bendable such that the pair of prongs are configured to clamp the cigarette between the pair of prongs.

12 Claims, 6 Drawing Sheets

CIGARETTE HOLDING AND EXTINGUISHING KIT

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to cigarette holders and more particularly pertains to a new cigarette holder for aiding a user to grasp a cigarette.

(2) Description of Related Art Including Information Disclosed Under 37 CFR 1.97 and 1.98

The prior art discloses devices for holding cigarettes but fails to disclose a cigarette holder with a handle and a pair of prongs such that the prongs clamp a cigarette distally from the handle. Such an apparatus would be advantageous for allowing a user to keep the user's hands in a more comfortable position while using the cigarette. For example, a user could rest the hand which grasps the cigarette holder against a support surface which is spaced from the user's mouth. The user could also position the hand below the user's mouth such that the user would not be required to lift the hand all the way from a natural resting position of the hand to the user's mouth. Such advantages may be particularly useful to individuals with arthritis or other conditions which cause pain or limit movement of the individual's hands.

(h) BRIEF SUMMARY OF THE INVENTION

An embodiment of the disclosure meets the needs presented above by generally comprising a cigarette holder with a handle and a pair of prongs. The handle is elongated between a first end and a second end of the handle. A front side and a rear side of the handle extend between the first end and the second end. A pair of lateral sides extend between the first end and the second end and between the front side and the rear side. The pair of prongs is coupled to the second end of the handle. The prongs extend parallel to a central longitudinal axis of the handle away from the second end. The prongs are laterally spaced from each other with respect to the handle. Each prong of the pair of prongs is resiliently bendable such that the pair of prongs are configured to clamp a cigarette between the pair of prongs.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
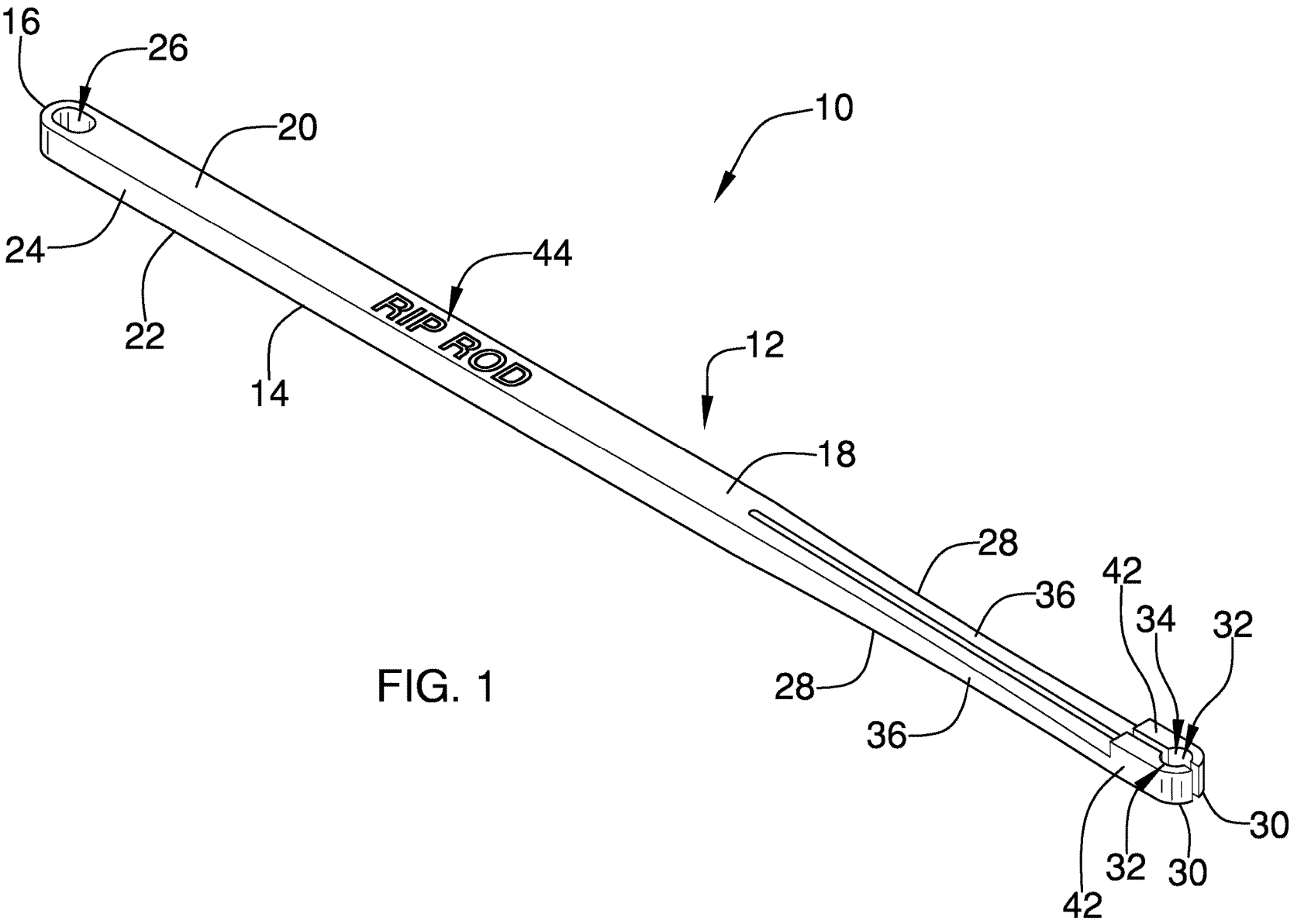
FIG. 1 is a perspective view of a cigarette holding and extinguishing kit according to an embodiment of the disclosure.
Figure 2:
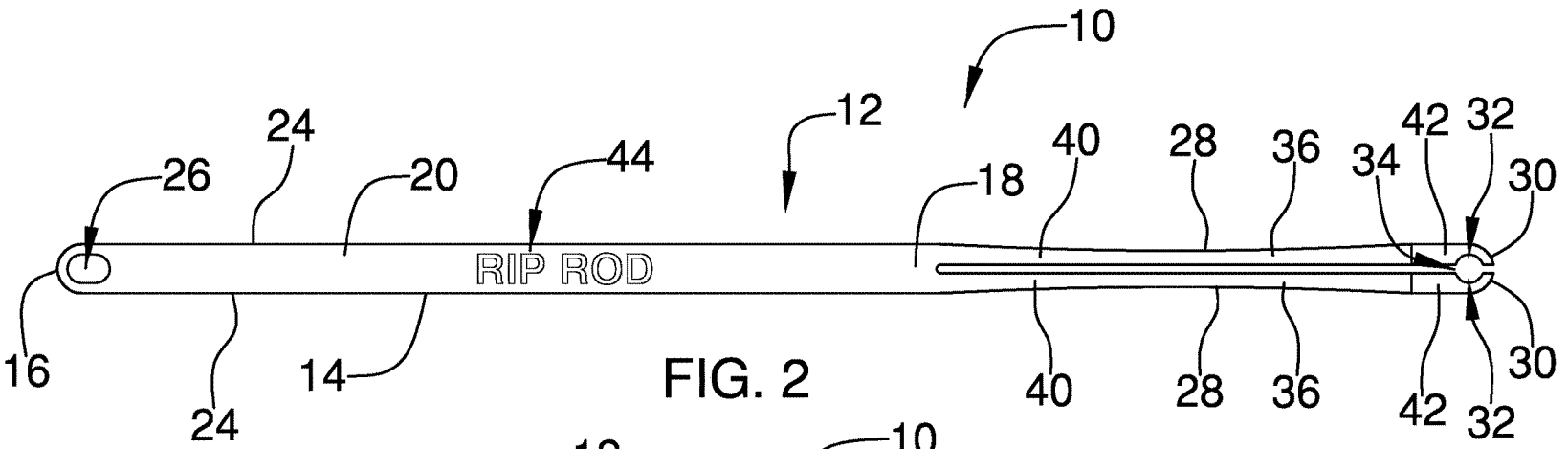
FIG. 2 is a front view of an embodiment of the disclosure.
Figure 3:
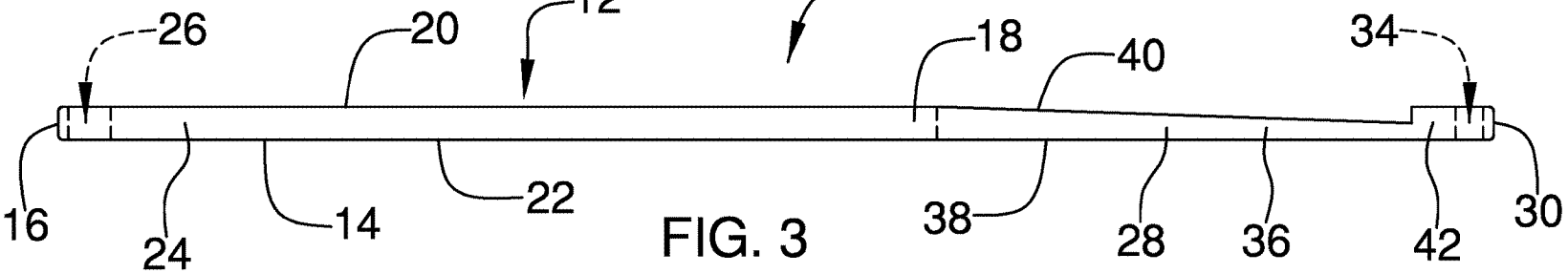
FIG. 3 is a side view of an embodiment of the disclosure.
Figure 4:
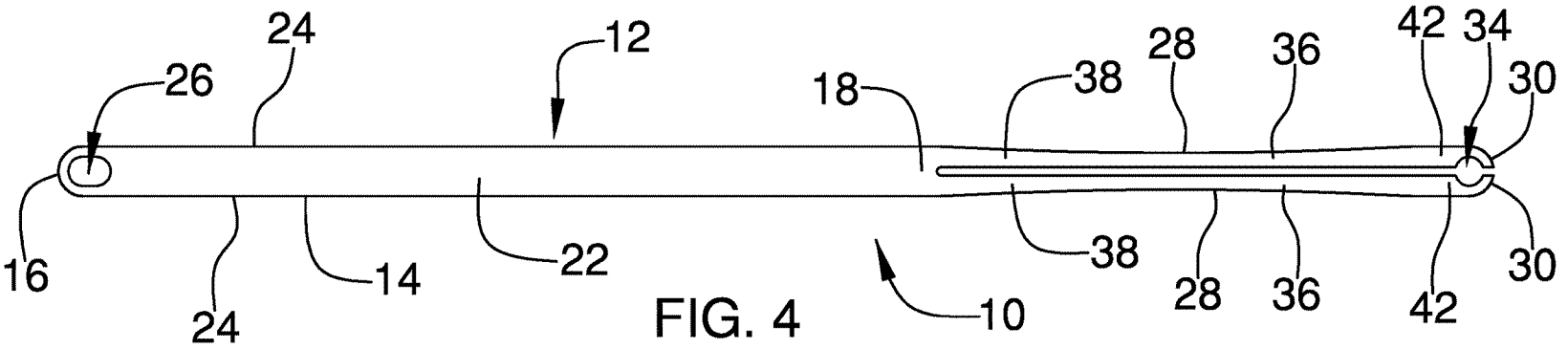
FIG. 4 is a rear view of an embodiment of the disclosure.
Figure 5:
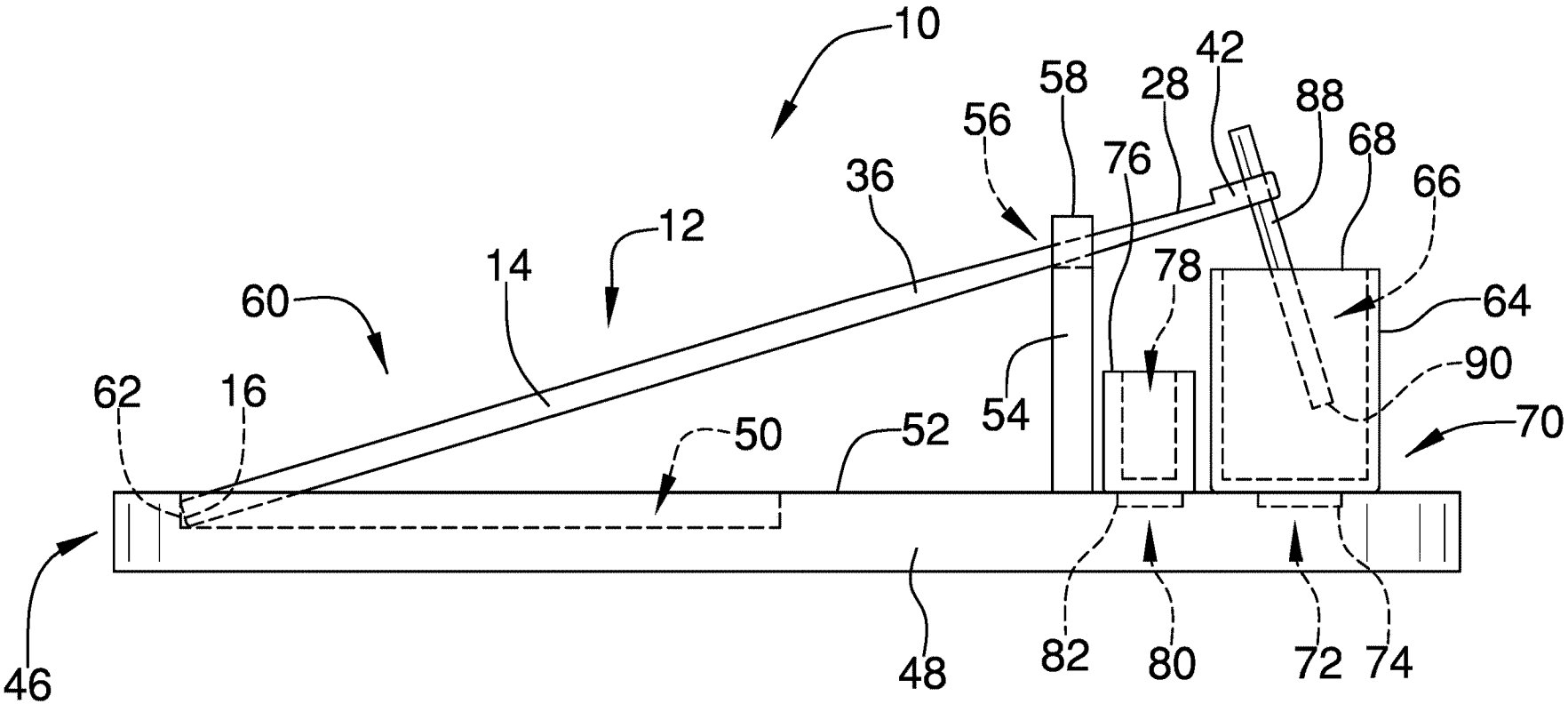
FIG. 5 is a side in-use view of an embodiment of the disclosure.
Figure 6:
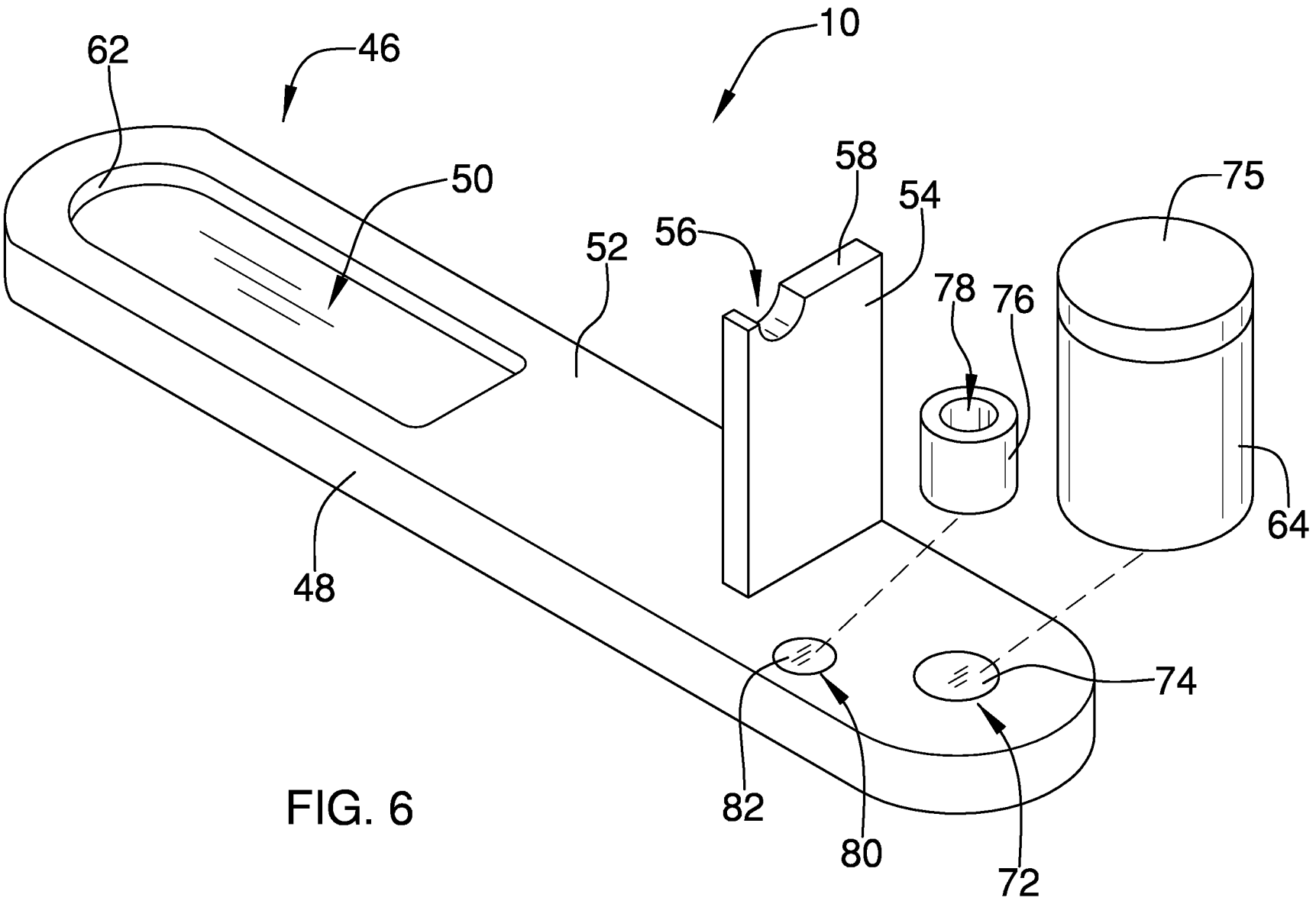
FIG. 6 is a perspective exploded view of a stand, an ashtray, and a snuffer of an embodiment of the disclosure.
Figure 7:
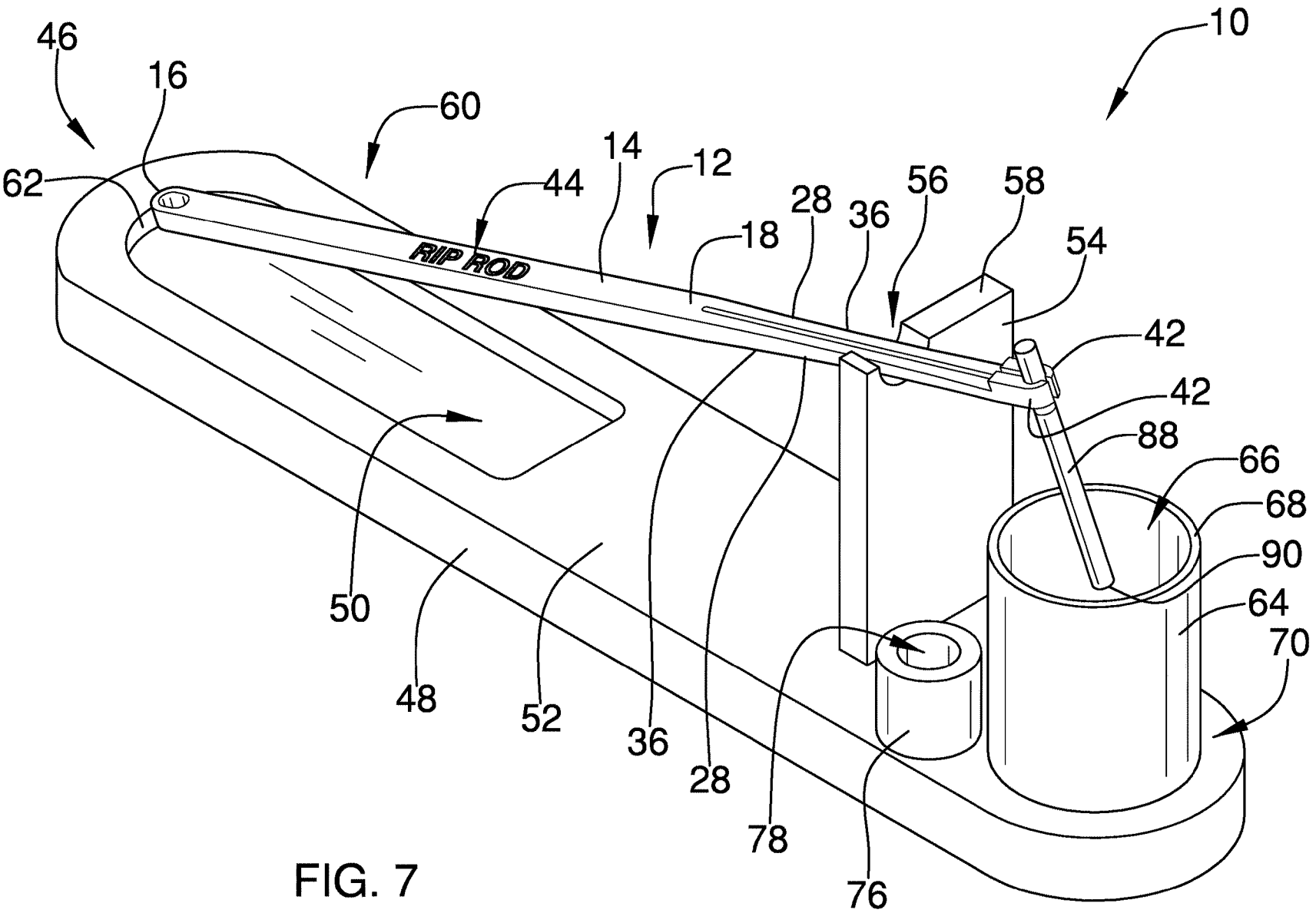
FIG. 7 is a perspective in-use view of an embodiment of the disclosure.
Figure 8:
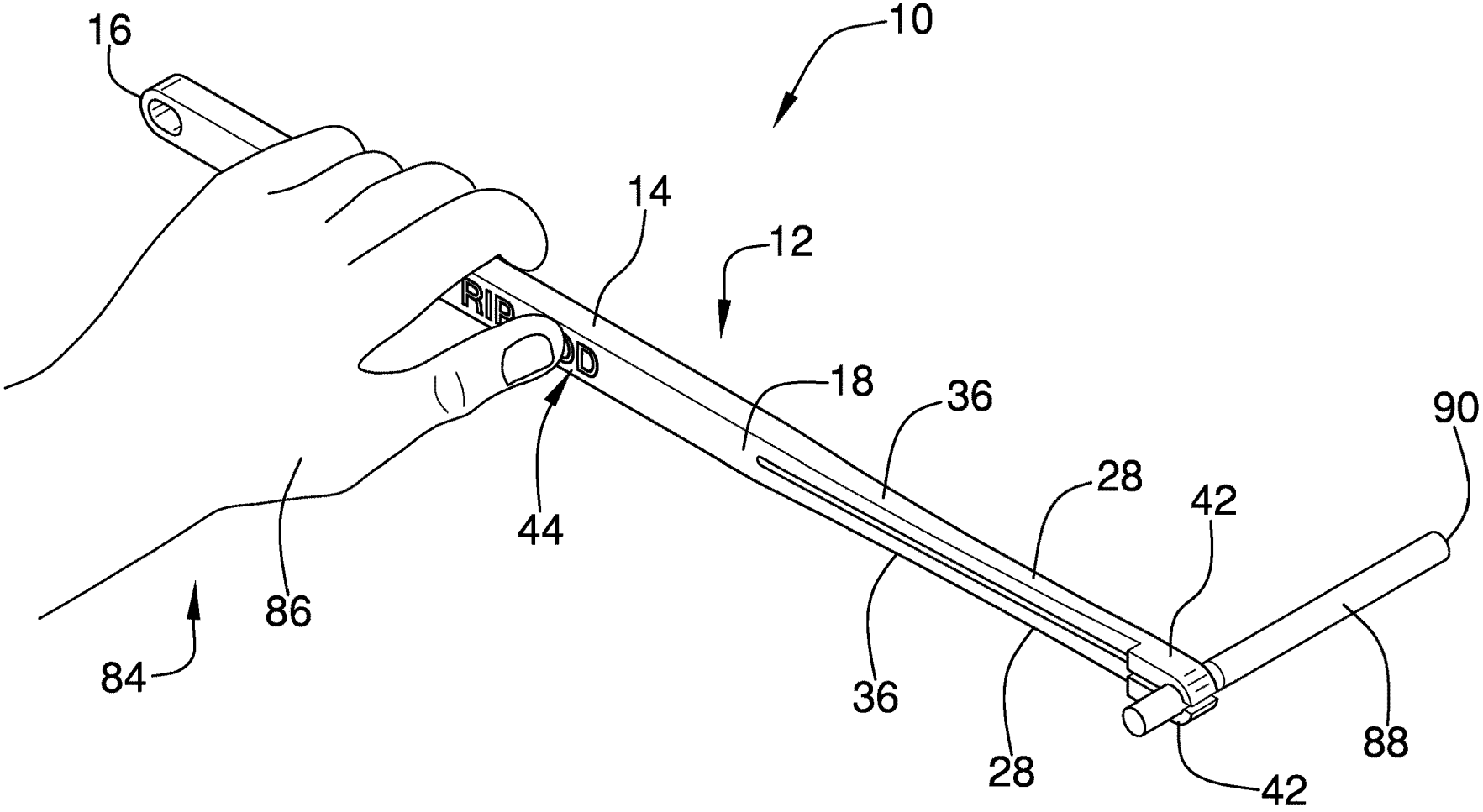
FIG. 8 is a perspective in-use view of an embodiment of the disclosure.

With reference now to the drawings, and in particular to FIGS. 1 through 8 thereof, a new cigarette holder embodying the principles and concepts of an embodiment of the disclosure and generally designated by the reference numeral 10 will be described.

As best illustrated in FIGS. 1 through 8, the cigarette holding and extinguishing kit 10 generally comprises a cigarette 88 holder 12 which has a handle 14 and a pair of prongs 28. The handle 14 is elongated between a first end 16 and a second end 18 of the handle 14. A front side 20 and a rear side 22 of the handle 14 each extend between the first end 16 and the second end 18. A pair of lateral sides 24 extends between the first end 16 and the second end 18 and between the front side 20 and the rear side 22. The handle 14 has a lanyard hole 26 which extends through the handle 14 adjacent to the first end 16. The lanyard hole 26 extends transversely with respect to a central longitudinal axis of the handle 14 and is sized to receive a lanyard (not shown) to attach the handle 14 to the lanyard.

The pair of prongs 28 is coupled to the second end 18 of the handle 14 and extends parallel to the central longitudinal axis of the handle 14 away from the second end 18. The prongs 28 are laterally space 34*d* from each other with respect to the handle 14. Each prong 28 of the pair of prongs 28 has a recess 32 adjacent to a distal end 30 of the prong 28 with respect to the handle 14. The recesses 32 of the pair of prongs 28 define a space 34 between the pair of prongs 28 for receiving a cigarette 88. Each prong 28 of the pair of prongs 28 is resiliently bendable such that the pair of prongs 28 are configured to clamp the cigarette 88 in the space 34 between the pair of prongs 28. The space 34 has a cylindrical shape, and a central longitudinal axis of the space 34 extends forwardly and rearwardly with respect to the handle 14.

Each prong 28 of the pair of prongs 28 comprises an extension portion 36 and a holder portion 42. The extension portion 36 extends from the handle 14 to the holder portion 42 and defines the recess 32. A rear surface 38 of the extension portion 36 is oriented coplanar to the rear side 22 of the handle 14, and a front surface 40 of the extension portion 36 is angled toward the rear surface 38 from the handle 14 to the holder portion 42. The holder portion 42 protrudes forwardly from the extension portion 36 with respect to the handle 14.

The prongs 28 are integrally formed with the handle 14. The cigarette 88 holder 12 is constructed of wood, but may comprise any material suitable to hold the cigarette 88 and facilitate bending of the prongs 28 as described. The cigarette 88 holder 12 also includes an indicia 44 positioned on the front side 20 of the handle 14 which indicates an orientation of the handle 14. The indicia 44 may include alphanumeric characters, symbols, graphical images, logos, or the like. The indicia 44 comprises engraved markings such that the indicia 44 is detectable via touch. The indicia 44 also may comprise embossed markings to achieve the same result.

A stand 46 is positionable to support 54 the cigarette 88 holder 12. The stand 46 comprises a base 48 and a support 54. The base 48 defines a cavity 50 which extends downwardly through a top surface 52 of the base 48. The support 54 is coupled to and extends upwardly from the base 48. The support 54 is spaced from the cavity 50 and has a notch 56 extending into a top side 58 of the support 54. The cigarette 88 holder 12 is positionable in a support position 60 with respect to the stand 46 wherein the first end 16 of the handle 14 abuts a bounding surface 62 of the cavity 50 and the cigarette 88 holder 12 lies in the notch 56 of the support 54. The stand 46 props the cigarette 88 holder 12 when the cigarette 88 holder 12 is in the support position 60 to space 34 the cigarette 88 above the base 48.

An ashtray 64 is positionable on the base 48 of the stand 46 in a collection position 70 wherein the ashtray 64 is positioned under the holder portions 42 of the pair of prongs 28 when the cigarette 88 holder 12 is positioned in the support position 60. The ashtray 64 has a reservoir 66 which is open at a top end 68 of the ashtray 64. An ashtray connector 72 is coupled to the base 48 of the stand 46 and the ashtray connector 72 comprises an ashtray magnet 74. The ashtray 64 comprises an ashtray ferromagnetic material such that the ashtray magnet 74 releasably secures the ashtray 64 to the base 48. The ashtray connector 72 also may comprise other fastening means such as a hook-and-loop fastener, a latch, an inset surface, or the like. A lid 75 may also be provided which is removably positionable on the top end 68 of the ashtray 64 to cover the reservoir 66.

A snuffer 76 is positionable on the base 48 of the stand 46. The snuffer 76 has a channel 78 which extends into the snuffer 76. The channel 78 has a size such that the channel 78 is configured to receive a combustion end 90 of the cigarette 88 and inhibit airflow to the combustion end 90 to extinguish the cigarette 88. A snuffer connector 80 is coupled to the base 48 of the stand 46 and comprises a snuffer magnet 82. The snuffer 76 comprises a snuffer ferromagnetic material such that the snuffer magnet 82 releasably secures the snuffer 76 to the base 48. The snuffer connector 80 also may comprise other fastening means such as a hook-and-loop fastener, a latch, an inset surface, or the like.

In use, the cigarette 88 is positioned in the prongs 28 of the cigarette 88 holder 12 so that the cigarette 88 holder 12 grasps the cigarette 88 for a user 84, who may hold the handle 14 of the cigarette 88 holder 12. The cigarette 88 holder 12 may assist the user 84 in holding the cigarette 88 by allowing the user 84 to place the user's 84 hands 86 in a more natural or comfortable position than near the mouth of the user 84. For example, the user 84 may rest the user's 84 hands 86 on an armrest or other surface while holding the handle 14 such that the cigarette 88 is positioned near the user's 84 mouth. The indicia 44 assists the user 84 in determining via touch a current position of the cigarette 88 holder 12 and consequently a current position of the cigarette 88.

The cigarette 88 holder 12 may be set on the stand 46 while holding the cigarette 88 over the ashtray 64 to ensure ashes and combusting material falls only into the ashtray 64. The cavity 50, in addition to being used to support 54 the first end 16 of the handle 14 of the cigarette 88 holder 12, may be used as a tray to hold items, such as lighters, matches, and the like. The snuffer 76 may be used to extinguish the cigarette 88 as described. The ashtray connector 72 and the snuffer connector 80 prevent inadvertently misplacing the ashtray 64 and the snuffer 76 respectively in a remote location from the stand 46.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

The invention claimed is:

1. A cigarette holding and extinguishing kit comprising:

a cigarette holder comprising:

a handle being elongated between a first end and a second end of the handle, a front side and a rear side extending between the first end and the second end, a pair of lateral sides extending between the first end and the second end and between the front side and the rear side; and a pair of prongs being coupled to the second end of the handle, the pair of prongs extending parallel to the central longitudinal axis of the handle away from the second end, the pair of prongs being laterally spaced from each other with respect to the handle, each prong of the pair of prongs being resiliently bendable such that the pair of prongs are configured to clamp a cigarette between the pair of prongs; and a stand being positionable to support the cigarette holder, the stand comprising:

a base, the base defining a cavity extending downwardly through a top surface of the base; and a support being coupled to and extending upwardly from the base, the support being spaced from the cavity, the support having a notch extending into a top side of the support;

wherein the cigarette holder is positionable in a support position with respect to the stand wherein the first end of the handle abuts a bounding surface of the cavity and the cigarette holder lies in the notch of the support, the stand propping the cigarette holder when the cigarette holder is in the support position wherein the stand is configured to space the cigarette above the base.

2. The kit of claim 1, further comprising an ashtray, the ashtray being positionable on the base of the stand in a collection position wherein the ashtray is positioned under the holder portions of the pair of prongs when the cigarette holder is positioned in the support position, the ashtray having a reservoir which is open at a top end of the ashtray.

3. The kit of claim 2, further comprising an ashtray connector, the ashtray connector being coupled to the base of the stand.

4. The kit of claim 3, wherein the ashtray connector comprises an ashtray magnet, the ashtray comprising an ashtray ferromagnetic material such that the ashtray magnet releasably secures the ashtray to the base.

5. The kit of claim 1, further comprising a snuffer, the snuffer being positionable on the base of the stand, the snuffer having a channel extending into the snuffer, the channel having a size such that the channel is configured to receive a combustion end of the cigarette and inhibit airflow to the combustion end to extinguish the cigarette.

6. The kit of claim 5, further comprising a snuffer connector, the snuffer connector being coupled to the base of the stand.

7. The kit of claim 6, wherein the snuffer connector comprises a snuffer magnet, the snuffer comprising a snuffer ferromagnetic material such that the snuffer magnet releasably secures the snuffer to the base.

8. The kit of claim 1, wherein each prong of the pair of prongs has a recess adjacent to a distal end of the prong with respect to the handle, the recesses of the pair of prongs defining a space between the pair of prongs, the pair of prongs are configured to clamp a cigarette in the space between the pair of prongs.

9. The kit of claim 8, wherein each prong of the pair of prongs comprising an extension portion and a holder portion, the extension portion extending from the handle to the holder portion, the holder portion defining the recess, a rear surface of the extension portion being oriented coplanar to the rear side of the handle, a front surface of the extension portion being angled toward the rear surface from the handle to the holder portion, the holder portion protruding forwardly from the extension portion with respect to the handle.

10. The kit of claim 1, wherein the cigarette holder further comprises an indicia being coupled to the front side of the handle, the indicia indicating an orientation of the handle.

11. The kit of claim 10, wherein the indicia comprises engraved markings such that the indicia is detectable via touch.

12. A cigarette holding and extinguishing kit comprising:

a cigarette holder comprising:

a handle being elongated between a first end and a second end of the handle, a front side and a rear side extending between the first end and the second end, a pair of lateral sides extending between the first end and the second end and between the front side and the rear side, the handle having a lanyard hole extending through the handle adjacent to the first end, the lanyard hole extending transversely with respect to a central longitudinal axis of the handle;

a pair of prongs being coupled to the second end of the handle, the pair of prongs extending parallel to the central longitudinal axis of the handle away from the second end, the pair of prongs being laterally spaced from each other with respect to the handle, each prong of the pair of prongs having a recess adjacent to a distal end of the prong with respect to the handle, the recesses of the pair of prongs defining a space between the pair of prongs, each prong of the pair of prongs being resiliently bendable such that the pair of prongs are configured to clamp a cigarette in the space between the pair of prongs, the space having a cylindrical shape, a central longitudinal axis of the space extending forwardly and rearwardly with respect to the handle, each prong of the pair of prongs comprising an extension portion and a holder portion, the extension portion extending from the handle to the holder portion, the holder portion defining the recess, a rear surface of the extension portion being oriented coplanar to the rear side of the handle, a front surface of the extension portion being angled toward the rear surface from the handle to the holder portion, the holder portion protruding forwardly from the extension portion with respect to the handle, the pair of prongs being integrally formed with the handle; and an indicia being coupled to the front side of the handle, the indicia indicating an orientation of the handle, the indicia comprising engraved markings such that the indicia is detectable via touch;

a stand being positionable to support the cigarette holder, the stand comprising:

a base, the base defining a cavity extending downwardly through a top surface of the base; and a support being coupled to and extending upwardly from the base, the support being spaced from the cavity, the support having a notch extending into a top side of the support;

wherein the cigarette holder is positionable in a support position with respect to the stand wherein the first end of the handle abuts a bounding surface of the cavity and the cigarette holder lies in the notch of the support, the stand propping the cigarette holder when the cigarette holder is in the support position wherein the stand is configured to space the cigarette above the base;

an ashtray being positionable on the base of the stand in a collection position wherein the ashtray is positioned under the holder portions of the pair of prongs when the cigarette holder is positioned in the support position, the ashtray having a reservoir which is open at a top end of the ashtray;

an ashtray connector being coupled to the base of the stand, the ashtray connector comprising an ashtray magnet, the ashtray comprising an ashtray ferromagnetic material such that the ashtray magnet releasably secures the ashtray to the base;

a snuffer being positionable on the base of the stand, the snuffer having a channel extending into the snuffer, the channel having a size such that the channel is configured to receive a combustion end of the cigarette and inhibit airflow to the combustion end to extinguish the cigarette; and a snuffer connector being coupled to the base of the stand, the snuffer connector comprising a snuffer magnet, the snuffer comprising a snuffer ferromagnetic material such that the snuffer magnet releasably secures the snuffer to the base.

* * * * *